US005901954A

United States Patent [19]

Allmendinger et al.

[11] Patent Number: 5,901,954

[45] Date of Patent: May 11, 1999

[54] APPARATUS FOR THE ALIGNMENT OF STACKED SHEETS TO BE DEPOSITED SUPERIMPOSED

[75] Inventors: Franz Allmendinger, Aichwald; Karsten König, Stuttgart, both of Germany

[73] Assignee: Eastman Kodak Company, Rochester, N.Y.

[21] Appl. No.: 08/906,194

[22] Filed: Aug. 5, 1997

[30] Foreign Application Priority Data

Oct. 11, 1996 [DE] Germany ..... 196 41 918

[51] Int. Cl.[6] ..... B65H 31/36; B65H 31/26; B65H 9/00; B65H 9/12

[52] U.S. Cl. ..... 271/221; 271/220; 271/240; 271/241

[58] Field of Search ..... 271/220, 221, 271/240, 241; 414/907, 788

[56] References Cited

U.S. PATENT DOCUMENTS

| | | | |
|---|---|---|---|
| 558,041 | 12/1996 | Nakayama | 271/220 |
| 3,733,070 | 5/1973 | Obenshain | 271/221 |
| 3,937,459 | 2/1976 | Lawrence | 271/240 |
| 4,657,239 | 4/1987 | Ikesue et al. | 271/173 |
| 5,228,679 | 7/1993 | Borostyan | 271/220 |
| 5,423,656 | 6/1995 | Filsinger et al. | 414/788 |
| 5,429,475 | 7/1995 | Mohr | 414/907 |
| 5,451,044 | 9/1995 | Nakayama | 271/220 |
| 5,513,839 | 5/1996 | Green | 271/221 |
| 5,516,092 | 5/1996 | Pollich | 271/220 |

FOREIGN PATENT DOCUMENTS

| | | | |
|---|---|---|---|
| 38 39 297 | 5/1990 | Germany . | |
| 406048616 | 2/1994 | Japan | 271/240 |

*Primary Examiner*—William E. Terrell
*Assistant Examiner*—Wonki Park
*Attorney, Agent, or Firm*—Lawrence P. Kessler

[57] ABSTRACT

A collecting station (1) has a first (3) and a second lateral side guide (4) which are movable transversely to the direction of transport (A). The first side guide (3) has a rigid alignment surface (3*a*) with a convex, arcuate surface and, for the alignment of a deposited sheet, is moved at a first, high speed to an intermediate position and from there at a second, lower speed to the alignment end position. The second side guide (4) is provided with flexible bristles (5) which compensate for sheet tolerances and which are inclined downwards at an angle of 45°. When the first side guide (3) comes to a standstill, the second side guide (4) is moved at a high speed to the alignment end position, then at a high speed back to an intermediate position in which contact with the sheets is no longer established, and thereafter at a lower speed back again to the alignment end position. For the return of the side guides (3 or 4), firstly the second side guide (4) and then the first side guide (3) are moved.

6 Claims, 3 Drawing Sheets

APPARATUS FOR THE ALIGNMENT OF STACKED SHEETS TO BE DEPOSITED SUPERIMPOSED

The invention relates to an apparatus for the alignment of sheets which are individually supplied to a collecting station and are deposited there superimposed in stacked form. In their deposited position, the stacked sheets rest against a front stop and are aligned by two lateral, opposing side guides which are movable transversely to the direction of transport as well as in opposite directions to each other, symmetrically to a center line extending in the direction of transport.

In an apparatus known from U.S. Pat. No. 3,937,459, a pivotable alignment means are provided which move from a position outside the depositing area against the opposite sides of a stack of sheets and thus align the stack of sheets centrally. It is also known (U.S. Pat. No. 4,657,239) that the degree of tilting of sheets to be deposited can be determined by sensors arranged in the transport path and that the alignment movement can be controlled by a lateral alignment mechanism such that the sheets are aligned centrally to a longitudinal center line. In the known devices, the centric alignment of the sheets is performed without taking into consideration that the sheet dimensions might differ due to tolerances.

SUMMARY OF THE INVENTION

It is the object of the invention to provide an alignment apparatus such that a stack of sheets is formed which, irrespective of the sheet dimensions varying due to tolerances, is aligned exactly superimposed with one of two opposite sheet edges which extend parallel to the direction of transport. This object is attained in accordance with the invention in that a first lateral side guide has a rigid alignment surface, and a second lateral side guide has a flexible alignment mechanism formed by a plurality of flexible alignment elements and surface areas, respectively. Each of the side guides is movable by a separate drive motor, and both lateral side guides take up a start position outside the depositing area. The drive motors can be driven by a control unit such that the deposited sheet is initially aligned by the first lateral side guide symmetrically to the center line extending in the direction of transport, and the lateral side guide then remains in its alignment end position. Via its flexible alignment mechanism, the second lateral side guide then places the deposited sheet flush against the underlying sheets on the rigid alignment surface of the first lateral side guide. After the end of the alignment process of a sheet, firstly the second lateral side guide and then the first lateral side guide are moved back to their start positions.

In accordance with the invention, the object is also attained using a method by which sheets supplied individually to a collecting station, are deposited there superimposed in stacked form, rest in their deposited position against a front stop and are aligned symmetrically to a center line extending in the direction of transport by two lateral and opposite side guides which are movable transversely to the direction of transport as well as in opposite directions to each other, the method includes the following steps:

A. A first lateral side guide with a rigid alignment surface and a second lateral side guide with a flexibly designed alignment means are arranged in a start position outside the depositing area.

B. The first lateral side guide is moved from the start position to an alignment end position and aligns a deposited sheet symmetrically to the center line. The first lateral side guide remains in the alignment position.

C. The second lateral side guide is then moved from the start position to an alignment position and rests the deposited sheet flush with the underlying sheets against the first lateral side guide.

D. After termination of the sheet aligning process, the second lateral side guide and then the first lateral side guide are moved back to their start positions.

Advantageously, the first lateral side guide is initially moved at a high speed from the start position to an intermediate position which is spaced from the alignment end position and in which contact with the deposited and aligned sheets is not yet established. Then the first lateral side guide is moved at a lower speed from the intermediate position to the alignment end position, such lower speed prevents an impact to be made on the deposited and already aligned sheets.

In a further advantageous modification of the invention, the second lateral side guide is moved at a high speed from the start position to the alignment end position, is then moved back at a high speed from the alignment end position to an intermediate position in which contact with the sheets to be aligned is no longer established, and is then moved again at a lower speed from the intermediate position to the alignment end position. This measure ensures that sheets which are not exactly aligned can release tension again in order to be able to be exactly aligned on the second stroke.

The apparatus in accordance with the invention is designed such that when the second lateral side guide is in its alignment end position, the effective spacing of its flexible alignment elements and surface areas, respectively, from the planar alignment surface of the first lateral side guide is equal to or smaller than the smallest tolerance-related width and length of the sheets to be aligned, respectively. It is thus achieved in an advantageous manner that sheets which are shorter due to tolerances can also be aligned with accuracy, while after the end of the alignment process the flexible alignment elements and surface areas, respectively, can elastically evade the sheets which are longer due to tolerances.

The rigid alignment surface of the side guide preferably has a convex, arcuate surface extending in the direction of transport, whereas the alignment mechanism of the second lateral side guide is designed as a brush whose bristles are inclined downwards at an angle of 45°.

The apparatus in accordance with the invention allows a sheet edge to be precisely aligned on the rigid alignment surface and tolerances to be compensated for by the opposite brush-type alignment mechanism, simultaneously leading to a symmetrical alignment of the sheets and the sheet stack, respectively.

The arrangement and control of the lateral side guides in accordance with the invention advantageously allows the sheets which are deposited with their edges in exact alignment on a front stop, to be precisely aligned on a further lateral edge such that stapled sheet stacks can be produced with accurately aligned sheet edges in the stapling area and in an adjacent area. Further features and advantages can be inferred from the description of an embodiment shown in the drawing and from the subclaims.

DETAILED DESCRIPTION OF THE INVENTION

The apparatus in accordance with the invention is arranged downstream of the sheet intake of a further processing device into which copy sheets enter, discharged by a copier of a known type (not shown). The sheets are then collected in stack form in a collecting station 1 and are stapled batch by batch by means of staples. The collected set of sheets, stapled or not stapled, is removed from collecting station 1 by means of a gripper not shown, and is supplied to a depositing station. The alignment apparatus in accordance with the invention is part of such a further processing device of which only those components are shown which are essential for an understanding of the invention. A further processing device of this type is known, for example, from DE-OS 38 39 297.

Figure 1:
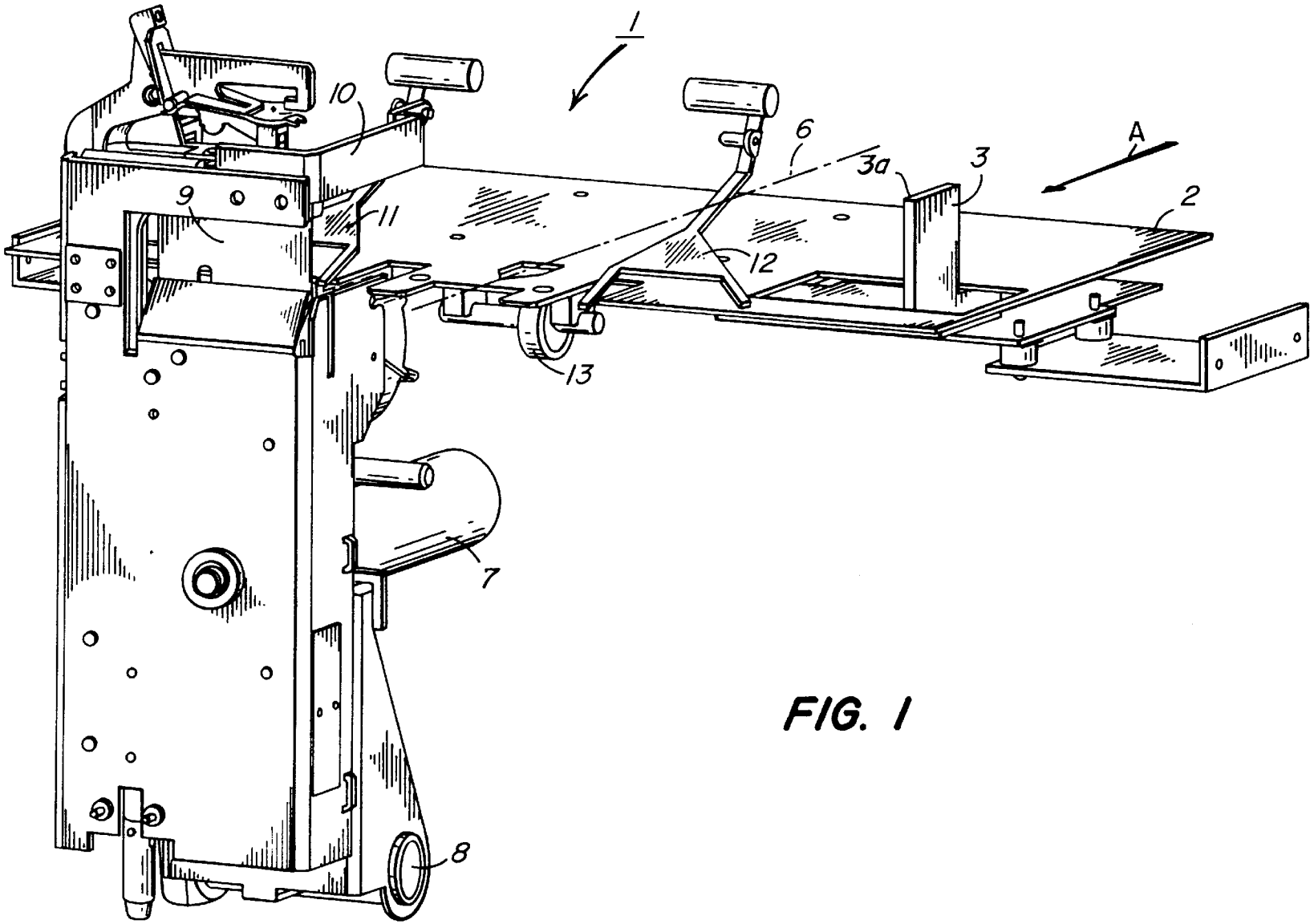
FIG. 1 illustrates the apparatus in an inclined view with a stapling device.
Figure 2:
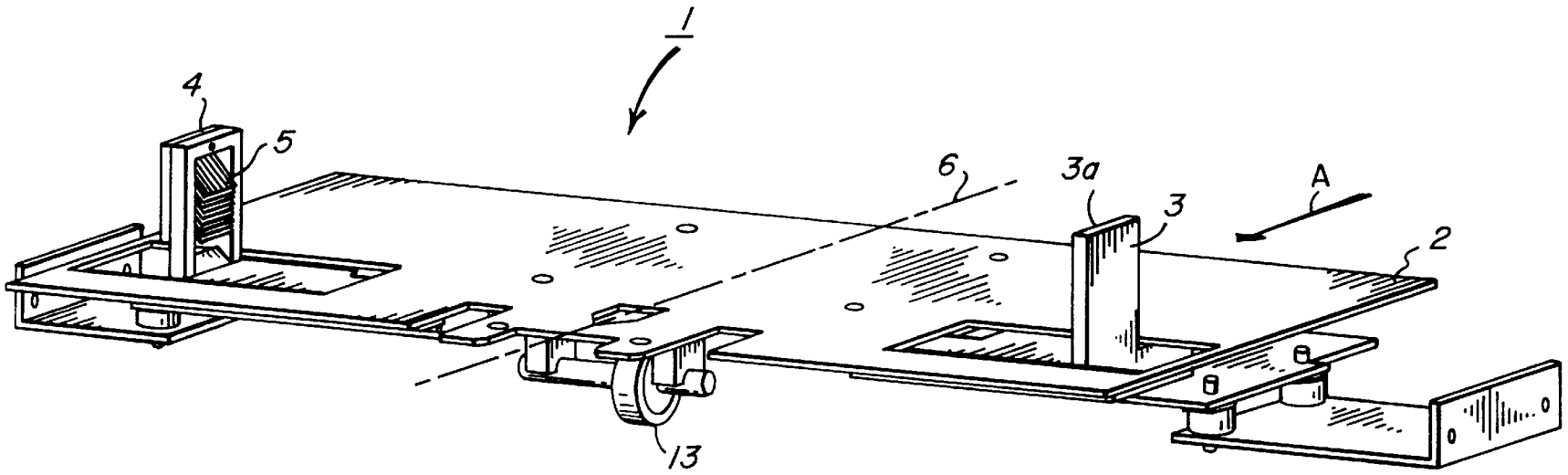
FIG. 2 illustrates the apparatus in accordance with FIG. 1 without the stapling device.

A collecting station 1 has a depositing surface 2, which, in its operative position and with reference to the direction of transport "A", is inclined downwards at an acute angle of about 40° (the inclined position is not shown in order to simplify the drawing). On the depositing surface 2, front stops 9 and lateral side guides 3 and 4 form a depositing area for the sheets, the front stops 9 are arranged on stapling devices 7. The stapling devices 7, of which one is located on the left and the other one on the right of the depositing area of the depositing surface 2 (for better clarity only one of the stapling devices 7 is shown in FIG. 1), overlap the depositing area of the collecting station 1. As such, a finished set of sheets can pass the stapling devices 7 in the direction of the arrow "A" when the front stops 9 which are movable downwards clear the transport path. By the guide bushes 8, the stapling devices 7 are guided displaceably along a guide rod (not shown) and are adjustable transversely to the direction of transport "A" in various stapling positions. The stapling devices 7 are associated with hold-down elements 11 and 12, respectively. The hold-down elements are pivotally hinged on the stapling devices 7 by holding mechanism, 10 (shown only in FIG. 1) and rest under the influence of gravity on the top of the stack. The front stops 9 serve to exactly align the front edges of sheets entering in the direction of transport "A". The lateral side guides 3 and 4 serve to align the edges of deposited sheets, such edges running parallel to the direction of transport "A", and are movable in opposite directions transversely to said direction "A". The lateral side guides 3 and 4 are arranged opposite to each other, and are supported so as to be guided displaceably on pull-out rails (not shown) of a known type. Each lateral side guide is movable in a straight line by a separate step motor via a pull belt of a known type not illustrated. The lateral side guides 3 and 4 are adjustable to different sheet formats and are movable from a start position outside the depositing area to an alignment end position where they assume a position in which the sheets aligned therewith are positioned symmetrically to a center line 6 extending in the direction of transport "A". The center line 6 extends in prolongation of the transport path of the sheets which are centrally oriented when entering the further processing device and thus the collecting station 1.

The first lateral side guide 3 is provided with a rigid alignment surface 3*a* which has a convex and arcuately shaped form and extends in the direction of transport "A". In combination with the front stops 9, this shape of the alignment surface 3*a* results in the sheets to be aligned having three contacting points so that even unfavorable tolerances (irregular edges due to uneven cutting) cannot have any effect on the alignment quality. The second lateral side guide 4 is provided on its alignment side with bristles 5 which are inclined downwards to the depositing surface 2 at an angle of 45°. The bristles 5 are formed, for example, of plastic and are embedded in a plastic carrier which is secured on the second lateral side guide 4. The strength of the bristles 5, arranged as densely as possible, is selected such that they have an adequate flexibility preventing damage to the sheets. Owing to that flexibility and their dense arrangement, the bristles 5 allow a very finely graduated efficacy in the alignment process, whereby compensation for different sheet tolerances is achieved. In addition, the bristles exert a damping effect on the sheets to be aligned, such that an impact on the sheets caused by rebound is avoided.

Figure 3:
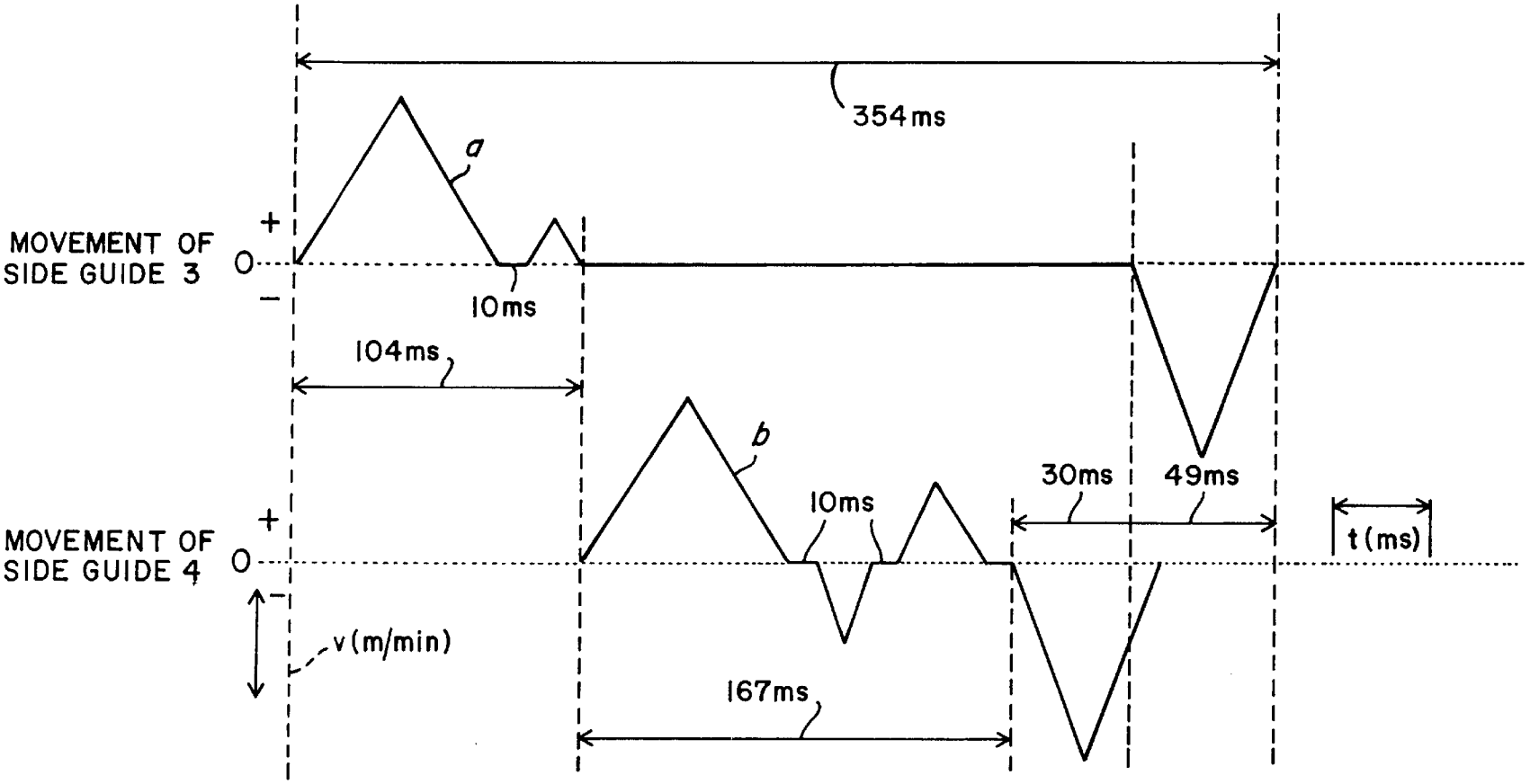
FIG. 3 illustrates a timing diagram of the apparatus in accordance with FIGS. 1 and 2.

A microprocessor-controlled device of a known type (not shown) controls the separate step motors which move the lateral side guides 3 and 4. The operational sequence is described and shown in the flow diagram of FIG. 3 (not true to scale) as well as in Table A, with the corresponding time, path and speed values. These values constitute an embodiment of the operational sequence and are coordinated with each other such that despite a fast alignment process a reliable alignment of the sheets with exact edge positioning is attainable.

TABLE A

| | 3 ahead 14 mm | waiting time | 3 ahead 1 mm | 4 ahead 15 mm | waiting time | 4 behind 4 mm | waiting time | 4 ahead 4 mm | waiting time | 4 behind 15 mm | waiting time | 3 behind 15 mm |
|---|---|---|---|---|---|---|---|---|---|---|---|---|
| max v | 10.2 m/min | | 6.1 m/min | 20.9 m/min | | 21.6 m/min | | 10.8 m/min | | 36 m/min | | 36 m/min |
| start ramp | 38 ms | | 8 ms | 39 ms | | 10 ms | | 18 ms | | 20 ms | | 20 ms |
| stop ramp | 39 ms | | 9 ms | 41 ms | | 14 ms | | 19 ms | | 29 ms | | 29 ms |
| total | 77 ms | 10 ms | 17 ms | 80 ms | 10 ms | 24 ms | 10 ms | 37 ms | 10 ms | 49 ms | 30 ms | 49 ms |

Transport rollers of a known type not illustrated, which are provided on the apparatus, convey a sheet in the direction of the arrow "A" to the collecting station 1. After the rear end of the incoming sheet has been released by the transport rollers, such sheet slides on the downwardly inclined depositing surface 2 downwards under the influence of gravity in the direction of the arrow "A". The sheet is rested on the front stops 9 and aligned there precisely by an alignment mechanism, for example a driven flywheel with elastic arms (not shown), which constantly acts on the top of the sheet by friction.

Immediately thereafter, the first lateral side guide 3 is moved at a first high speed of 20.2 m/min from its start position (preset depending on format) to an intermediate position where the alignment surface 3*a* of the first lateral side guide 3 is still 1 mm away from the already deposited and aligned sheets. After a brief waiting time of 10 ms, the first lateral side guide 3 is moved onward at a second, lower speed of 6.1 m/min to the alignment end position. By this second, substantially lower speed of movement, it is advantageously ensured that the second lateral side guide 4 cannot impact on sheets already deposited (with unchanged high speed from the start position to the alignment end position, the first lateral side guide 3 could overshoot due to the mass inertia and alter the position of the already deposited sheets in a disadvantageous manner), so that the sheets reliably maintain their aligned position. The first lateral side guide 3 remains in the alignment end position in which its alignment surface 3*a* is arranged symmetrically to the center line 6 with reference to the sheet format to be aligned.

Immediately when the first lateral side guide 3 reaches its alignment end position, the second lateral side guide 4 is moved at a first, high speed of 20.9 m/min from the start position (preset depending on format) to the alignment end position and is kept there for 10 ms. This alignment end position is selected such that the tips of the bristles 5 have a spacing from the alignment surface 3*a* of the opposite first lateral side guide 3, which is equal to or smaller than the smallest tolerance-related width and length, respectively, of the sheets to be aligned. The high speed, unchanged in this case, of the second lateral side guide 4 has no negative effect on the sheet to be aligned or on the already deposited sheets, because the opposite first lateral side guide 3 prevents the sheets from giving way and the flexible bristles 5 have a damping effect when impacting on the deposited sheets. Due to the large number of bristles 5, each deposited sheet is grasped and is rested irrespective of tolerance against the opposite, first lateral side guide 3, the alignment surface 3*a* of which is rigidly designed and arranged.

The second lateral side guide 4 is moved a second time in principle, so that sheets which were not exactly aligned during the first stroke or, for example, are bowed in the case of very thin sheets, can be deposited precisely. To this end, the second lateral side guide 4 is moved back by about 4 mm to an intermediate position after a short waiting time of 10 ms at a high speed of 21.6 m/min. In this position, the bristles 5 no longer contact the sheets and assume a spacing of about 1 mm from the sheets, respectively. This measure allows the deposited sheet to release tension, if required, and to be exactly aligned during the subsequent second alignment process.

After a further short waiting time of 10 ms, the second lateral side guide 4 is moved for the second time to the alignment end position, this movement being carried out at a second, lower speed of 10.8 m/min. In this second alignment process, sheets which are not yet properly aligned are then correctly rested against the opposite first side guide 3. The alignment process for a sheet is thereby ended. Then the two lateral side guides 3 or 4 are moved back to their start positions. This return movement occurs in a staggered time sequence such that after a short waiting time of 10 ms, firstly the second lateral side guide 4 is moved back at a high speed of 36 m/min from the alignment end position to the start position. After the bristles 5 of the second lateral side guide 4 have rebounded to the extent that they no longer contact the sheets, the return movement of the first lateral side guide 3 to the start position is also carried out at a high speed of 36 m/min. The fact that the return of the lateral side guides 3 and 4, respectively, occurs in a staggered time sequence ensures that the bristles 5 of the lateral side guide 4 which is returning first, can no longer displace the sheet stack resting in the correct position against the first lateral side guide 3.

Each individual sheet is aligned in the manner described above using the alignment apparatus. When the further processing device has a hold-back device (not shown) which is associated with the alignment apparatus described and by which some sheets are held back temporarily in a known manner such that an already deposited sheet stack can be stapled and/or removed, the sheets then released by the hold-back device for movement to the depositing surface 2 can also be aligned in the way described above. After the intended number of sheets has been deposited and aligned, the finished sheet stack is stapled using the stapling devices 7. The edges of the sheets are precisely aligned such that with their end sides facing the stapling and with their adjacent top sides the sheets form a finished, readably positioned sheet product whose most important edges are properly aligned. Removal of the finished sheet stack is assisted by means of a transport wheel 13 arranged below the depositing surface 2 and projecting through it. The transport wheel is set in motion by the removal process mentioned initially.

In contrast with the operational sequence described above, this can also take place at a slower speed, if this is expedient. A faster sequence is also possible, as long as it proceeds within the known operational limits. Differing from the embodiment described, the alignment movement of the first lateral side guide 3 can also be performed such that the approach to the alignment end position is continuously slowed in the last range of the movement path until a standstill is reached in the alignment end position. In contrast to the embodiment, the second lateral side guide 4 can also be provided with a plush or sealskin-type cover (sealskin for skiers) on its alignment side, if that cover allows the tolerance described above to be compensated for owing to its structure and flexibility. A correspondingly soft foam is also suitable, if it is flexible enough for the tolerances described to be compensated for.

Differing from the embodiment described, the control of the second lateral side guide 4 from the start position to the alignment end position can also take place in the same way as that of the first lateral side guide 3, i.e. without return movement to an intermediate position. This may be especially advantageous when the alignment means acting on the top of the sheets to be aligned with the front stops 9 is not constantly in position, but is briefly raised after the alignment of each individual sheet. In such an operating mode, the sheet to be aligned can release tension in each case before it is grasped by the lateral side guides 3 and 4, respectively, such that a second alignment movement is not necessary.

The invention has been described in detail with particular reference to certain preferred embodiments thereof, but it will be understood that variations and modifications can be effected within the spirit and scope of the invention.

What is claimed is:

1. Apparatus for the alignment of sheets which are individually supplied to a collecting station including a front stop, two lateral opposing side guides (3, 4) having a first lateral side guide (3) and a second lateral side guide (4), said sheets are deposited on said collecting station, superimposed in stacked form, and which in their deposited position rest against said front stop and are aligned by said two lateral, opposing side guides (3, 4) which are movable transversely to the direction of transport as well as in opposite directions to each other, symmetrically to a center line extending in the direction of transport, characterized in that a said first lateral side guide (3) has a rigid alignment surface **(3*a*), said second lateral side guide (4) has a flexibly designed alignment means (5) formed by a plurality of flexible alignment elements and surface areas, respectively, a first drive motor for moving said first lateral side guide (3), a second drive motor for moving said second lateral side guide (4)**, a control unit for controlling said drive motors;

said lateral side guides (3, 4) take up a start position outside the depositing area; and said drive motors can be driven by means of said control unit such that the deposited sheet is initially aligned by the first lateral side guide (3) symmetrically to the center line (6) extending in the direction of transport (A), and that the lateral side guide (3) then remains in its alignment end position, and when said second lateral side guide (4) is in its alignment end position, the effective spacing of its alignment elements (5) and surface areas, respectively, from the planar alignment surface **(3*a*) of the first lateral side guide (3)** is equal to or smaller than the smallest tolerance-related width and length of the sheets to be aligned, respectively;

via its flexibly designed alignment means (5), said second lateral side guide (4) then places the deposited sheet flush against the underlying sheets on a rigid alignment surface **(3*a*) of said first lateral side guide (3); and after the end of the alignment process of a sheet, firstly the second lateral side guide (4) and then the first lateral side guide (3)** are moved back to their start positions.

2. Sheet alignment apparatus in accordance with claim 1, characterized in that said first lateral side guide (3) is movable at a first, high speed from the start position to an intermediate position which is spaced from the alignment end position and in which contact with the deposited and aligned sheets is not yet established, and that said first lateral side guide (3) is movable at a second, lower speed from the intermediate position to the alignment end position, said lower speed preventing an impact to be made on the deposited and already aligned sheets.

3. Sheet alignment apparatus in accordance with claim 2, characterized in that said second lateral side guide (4) is movable at a high speed from the start position to the alignment end position, said second lateral side guide (4) is movable back at a high speed from the alignment end position to an intermediate position in which contact with the sheets to be aligned is no longer established, and that said second lateral side guide (4) is movable at a lower speed from the intermediate position to the alignment end position.

4. Sheet alignment apparatus in accordance with claim 1, characterized in that said rigid alignment surface **(3*a*) of said first side guide (3)** has a convex, arcuate surface extending in the direction of transport (A).

5. Sheet alignment apparatus in accordance with claim 1, characterized in that said alignment means of said second lateral side guide (4) is a brush (5), said brush being provided with bristles (5) which are inclined downwards at an angle of 45° in the alignment direction of said second side guide (4).

6. Sheet alignment apparatus in accordance with claim 5, characterized in that said rigid alignment surface **(3*a*) of said first lateral side guide (3) and the front stop (9) of said collecting station (1)** are associated with that area of the sheet stack to be aligned.

* * * * *